US006821192B1

(12) United States Patent
Donohue

(10) Patent No.: US 6,821,192 B1
(45) Date of Patent: Nov. 23, 2004

(54) RETAINING RING FOR USE IN CHEMICAL MECHANICAL POLISHING

(75) Inventor: Timothy J. Donohue, Menlo Park, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 10/665,940

(22) Filed: Sep. 19, 2003

(51) Int. Cl.[7] ..... B24B 29/00
(52) U.S. Cl. ..... 451/285; 451/397
(58) Field of Search ..... 451/285, 286, 451/287, 288, 289, 397, 398

(56) References Cited

U.S. PATENT DOCUMENTS 5,643,061 A 7/1997 Jackson et al.
5,695,392 A 12/1997 Kim
5,944,593 A 8/1999 Chiu et al.
6,136,710 A 10/2000 Quek et al.
6,146,260 A 11/2000 Yi
6,183,354 B1 2/2001 Zuniga et al.
6,224,472 B1 5/2001 Lai et al.
6,267,643 B1 * 7/2001 Teng et al. ..... 451/41
6,419,567 B1 * 7/2002 Glashauser ..... 451/259
6,447,380 B1 * 9/2002 Pham et al. ..... 451/288

* cited by examiner

*Primary Examiner*—Dung Van Nguyen
(74) *Attorney, Agent, or Firm*—Fish & Richardson

(57) ABSTRACT

A retaining ring for use on a carrier head in a chemical mechanical polishing apparatus has a bottom surface, an inner surface and an outer surface, and a plurality of recesses on the bottom surface. Each recess can include an inner trailing surface and a slurry capture area. A channel can connect the slurry capture area to the inner surface. The inner trailing surface can be configured for fastening thereon an insert tool having a contact edge for abrasively contacting a polishing pad.

29 Claims, 11 Drawing Sheets

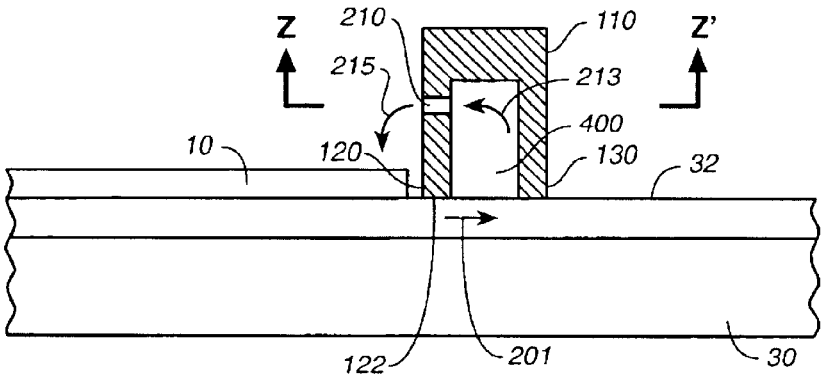
FIG._3B (A-A')
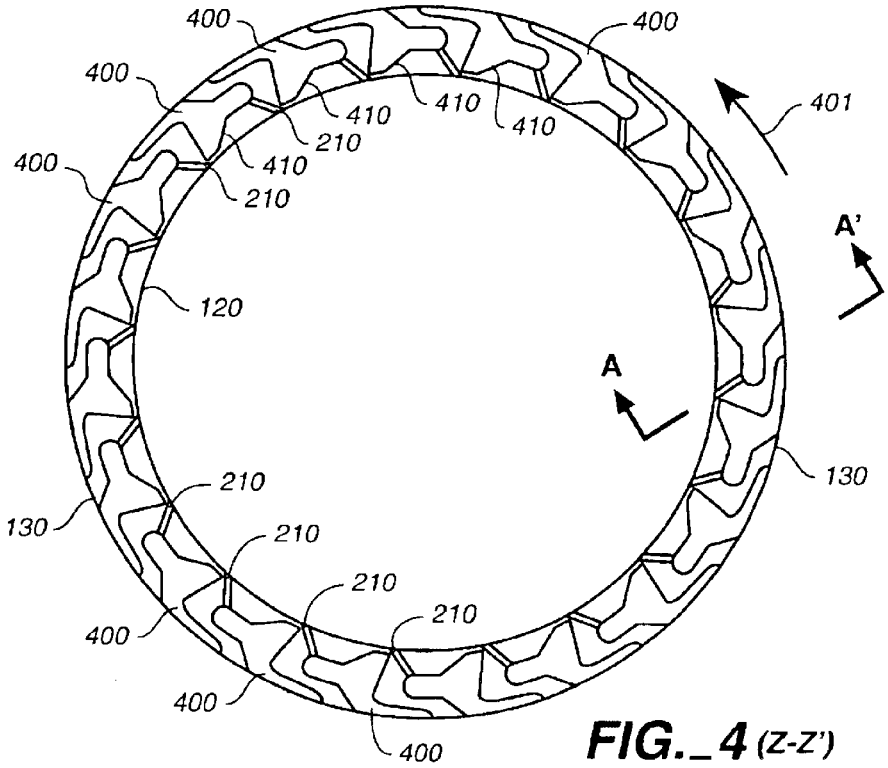
FIG._4 (Z-Z')

RETAINING RING FOR USE IN CHEMICAL MECHANICAL POLISHING

BACKGROUND

The present invention relates generally to chemical mechanical polishing of substrates, and more particularly to a retaining ring for use in chemical mechanical polishing.

Integrated circuits are typically formed on substrates, particularly silicon wafers, by the sequential deposition of conductive, semiconductive or insulative layers. After each layer is deposited, the layer is etched to create circuitry features. As a series of layers are sequentially deposited and etched, the outer or uppermost surface of the substrate, i.e., the exposed surface of the substrate, becomes successively less planar. This non-planar outer surface presents a problem for the integrated circuit manufacturer as a non-planar surface can prevent proper focusing of the photolithography apparatus. Therefore, there is a need to periodically planarize the substrate surface to provide a planar surface. Planarization, in effect, polishes away a non-planar, outer surface, whether a conductive, semiconductive, or insulative layer, to form a relatively flat, smooth surface.

Chemical mechanical polishing is one accepted method of planarization. This planarization method typically requires that the substrate be mounted on a carrier or polishing head, with the surface of the substrate to be polished exposed. The substrate is then placed against a rotating polishing pad. The carrier head may also rotate and/or oscillate to provide additional motion between the substrate and polishing surface. Further, a polishing slurry, including an abrasive and at least one chemically reactive agent, may be spread on the polishing pad to provide an abrasive chemical solution at the interface between the pad and substrate. In addition, the polishing pad may be periodically conditioned to maintain a uniform polishing rate.

SUMMARY

In one aspect, the invention is directed to a retaining ring for use on a carrier head in a chemical mechanical polishing apparatus. The retaining ring includes an annular ring having a bottom surface, an inner surface and an outer surface, and a plurality of recesses on the bottom surface. Each recess includes an inner trailing surface, a slurry capture area, and a channel connecting the slurry capture area to the inner surface.

Implementations of the invention may include one or more of the following features. The inner trailing surface may incline backward and form an acute angle with respect to the bottom surface or incline forward and form an obtuse angle with respect to the bottom surface. The inner trailing surface may be configured for fastening thereon an insert tool having a contact edge for abrasively contacting a polishing pad on the chemical mechanical polishing apparatus. The annular ring may be constructed from a material selected from a group consisting of polyphenyl sulfide (PPS), polyimide, polybenzimidazole (PBI), polytetrafluoroethylene (PTFE), polyetheretherketone (PEEK), polycarbonate, acetal, polyetherimide (PEI), or combinations thereof. At least one of the recesses may have a shape designed for nesting, and may be positioned on the bottom surface nested with at least another recess. The total recessed area covered by the plurality of recesses may constitute between 20% to 80% of the total projected surface area of the bottom surface. The channel may be positioned in a plane that is essentially parallel and at a distance from the bottom surface. Each recess may have a three-dimensional shape designed to maintain the functional performance of the retaining ring as a thickness of the retaining ring shrinks. Each recess may have a slurry feeding area, which can include an opening on the outer surface of the annular ring. A total surface area of all the openings on the outer surface may constitute between 20% to 80% of the total projected surface area of the outer surface. The inner surface may include a cut connecting to the channel. Each recess may include an outer trailing surface. The outer trailing surface may incline backward and form an acute angle with respect to the bottom surface, or incline forward and form an obtuse angle with respect to the bottom surface. An insert tool may be fastened on the inner trailing surface. The insert tool is made from a metal carbide. A surface of the insert tool may be treated to enhance wear resistance. The insert tool may have a contact edge including a single contact point, or multiple contact points. The insert tool may have an end in the form of a scraper blade, or an end in the form of a rounded peak. The insert tool may have a head that includes a rounded surface and a tilted surface. The insert tool may have a shoulder forgetting a height of a contact edge with respect to the bottom surface.

In another aspect, the invention is directed to a retaining ring for use on a carrier head in a chemical mechanical polishing apparatus. The retaining ring has an annular ring having a bottom surface, an inner surface and an outer surface, and a plurality of recesses on the bottom surface. Each recess includes an inner trailing surface configured for fastening thereon an insert tool having a contact edge for contacting abrasively a polishing pad on the chemical mechanical polishing apparatus.

Implementations of the invention may include one or more of the following features. An insert tool may be fastened on the inner trailing surface. The insert tool may be made from metal, and at least a portion of the surface of the insert tool may be coated with diamond. The insert tool may have a sharp edge coated with a diamond layer, or a rounded surface coated with a diamond grit. The insert tool may have a contact edge including a single contact point or multiple contact points. The insert tool may have an end in the form of a scraper blade or in the form of a rounded peak. The insert tool may have a head that includes a rounded surface and a tilted surface. The insert tool may have a shoulder for setting a height of a contact edge with respect to the bottom surface.

In another aspect, the invention is directed to a retaining ring for use on a carrier head in a chemical mechanical polishing apparatus. The retaining ring includes an annular ring having a bottom surface, an inner surface and an outer surface, and a plurality of recesses on the bottom surface. Each recess includes an inner trailing surface, an outer trailing surface, and a slurry capture area between the inner trailing surface and the outer trailing surface. A plurality of openings on the inner surface connect with the slurry capture area.

Implementations of the invention may include one or more of the following features. The inner trailing surface may incline backward and form an acute angle with respect to the bottom surface, or incline forward and form an obtuse angle with respect to the bottom surface. The outer trailing surface may incline backward and form an acute angle with respect to the bottom surface, or incline forward and form an obtuse angle with respect to the bottom surface.

The retaining ring and the slurry capture area may provide one or more of following advantages: (1) improved uniformity of the polishing rate over different areas on the substrate; (2) more efficient use of slurry; (3) the polishing pad can be in situ conditioned; (4) extension of the useful lifetime of the retaining ring; (5) reduced defects on the substrate; and (6) reduced consumption of deionized water for rinsing the substrate.

Additional advantages of the invention will be set forth in the description which follows, and in part will be obvious from the description, or may be learned by practice of the invention. The advantages of the invention may be realized by means of the instrumentalities and combinations particularly pointed out in the claims.

BRIEF DESCRIPTION OF THE DRAWINGS

The present invention will be understood more fully from the detailed description and accompanying drawings of the invention set forth herein. However, the drawings are not to be construed as limiting the invention to the specific embodiments shown and described herein.

FIG. 3B is a cross-sectional view of the retaining ring of FIG. 2 along line A–A' of FIG. 3A.

FIG. 4 is a cross-sectional planar view of the retaining ring of FIG. 2 along line Z–Z' of FIG. 3B.

Like reference numbers are designated in the various drawings to indicate like elements. A reference number primed indicates that an element has a modified function, operation or structure.

DETAILED DESCRIPTION

Figure 1A:
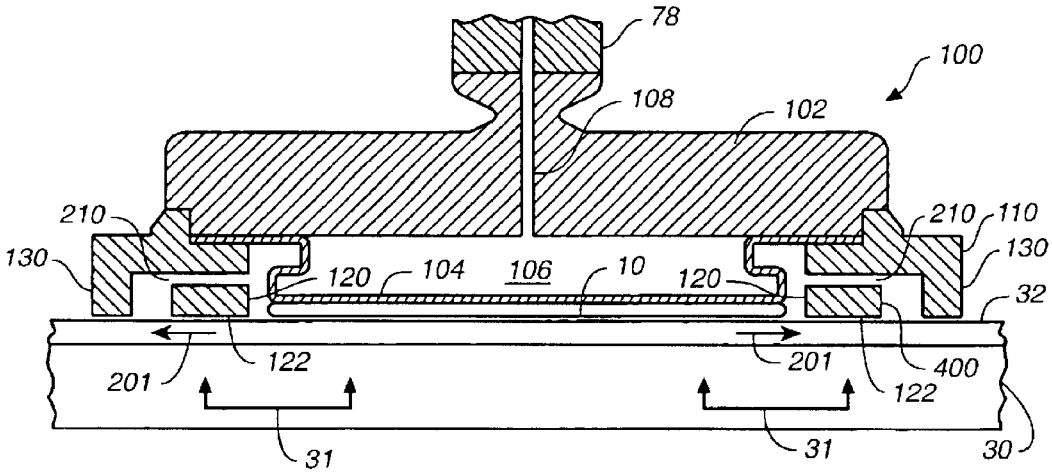
FIG. 1A is a cross-sectional view of an exemplary carrier head including a retaining ring.

As shown in FIG. 1A, a substrate 10 is held by a carrier head 100 for polishing in a chemical mechanical polishing (CMP) apparatus 20. A description of a CMP apparatus may be found in U.S. Pat. No. 5,738,574, the entire disclosure of which is incorporated herein by reference. The carrier head 100 holds the substrate against a polishing pad 32 which is supported by a rotatable platen 30.

The carrier head 100 can include a housing or base 102 and a flexible membrane 104 clamped to the housing 102 to form a chamber 106. The housing 102 is connected to the drive shaft 78, and may be generally circular in shape to correspond to the circular configuration of the substrate 10. Fluid may be injected into the chamber 106 through a passage 108 in the housing 102 to pressurize the chamber 106 and apply a load (i.e., a downward pressure) to the substrate. A discussion of a carrier head is found in U.S. Pat. Nos. 6,183,354 and 6,422,927, and in U.S. patent application Ser. No. 09/712,389, filed Nov. 13, 2000, the entire disclosures of which are incorporated herein by reference.

Figure 1B:
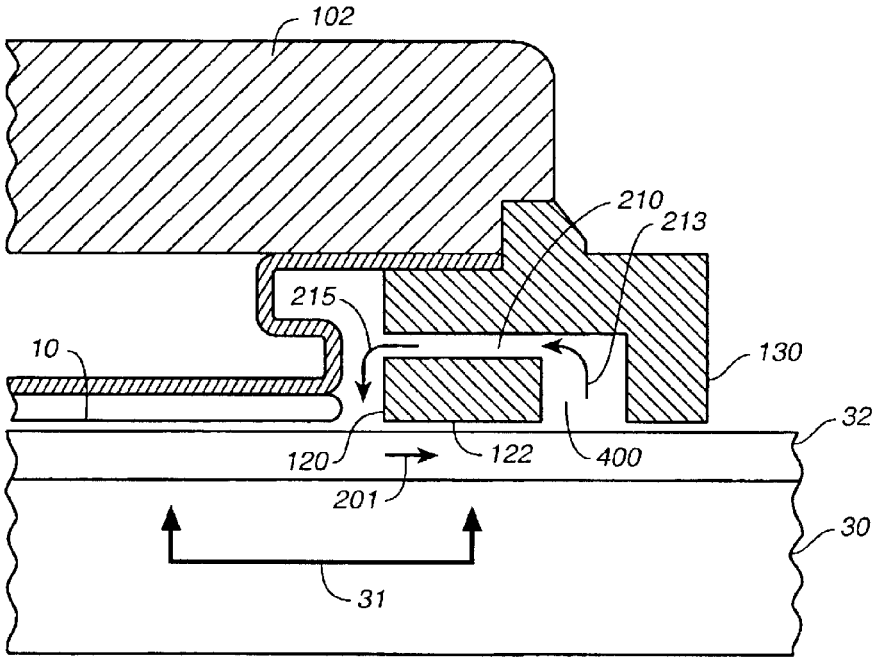
FIG. 1B is an expanded view illustrating a channel through the retaining ring in the carrier head of FIG. 1A.

Referring to FIGS. 1A and 1B, the carrier head 100 also includes a retaining ring 110 that can be secured at the outer edge of the housing 102, e.g., by screws or bolts (not shown) that fit into receiving holes (again, not shown) in the top surface of the retaining ring. The retaining ring 110 has an outer surface 130. The retaining ring 110 also has an inner surface 120 to engage the substrate 10 and prevent the substrate from slipping or sliding from beneath the carrier head 100 during polishing, and a bottom surface 122 which can contact and compress the polishing pad 32. During a CMP process, the substrate 10 also contacts and compresses the polishing pad 32. The bottom surface 122 of the retaining ring 110 can be substantially flat. The carrier head 100 can also include a chamber (not shown) to control the vertical position of the retaining ring 110 and the pressure of the retaining ring 110 on the polishing pad 32.

The polishing rate at a selected area on the substrate generally depends on the contact pressure between the substrate and the polishing pad at that selected area, the relative motion that exist between the substrate and polishing pad, and the slurry flow conditions. With many conventional retaining rings, a spatially uniform contact pressure between the substrate and the polishing pad cannot always be maintained near the substrate edge. For example, due to the elastic properties of the polishing pad, the contact pressure in a region near the edge of the substrate might be higher or lower than the contact pressure near the center of the substrate.

However, the uniformity of the polish rate on the substrate 10 can be improved by modifying the bottom surface 122 of the retaining ring 110 to exert a radial stretching force 201 on the polishing pad 32 near the region 31 adjacent the inner surface 120 of the retaining ring 110. When the polishing pad 32 is stretched by the stretching force 201, the contact pressure between the substrate 10 and the polishing pad 32 during normal polish process can be more uniform. Without being limited to any particular theory, stretching of the polishing pad may reduce compression or dynamic distortion waves in the polishing pad that would otherwise increase or reduce the local contact pressure near the edge of the substrate.

In order to exert the stretching force, the bottom surface 122 of the retaining ring 110 can be modified, for example, to include recesses or protrusions. These recesses or protrusions can be designed to improve the uniformity of the polish rate near the edge of a substrate when the substrate is positioned in the retaining ring and polished by a polishing pad. These recesses or protrusions can also be designed for conditioning a polishing pad at the same time a substrate positioned in the retaining ring is being polished by the polishing pad. A retaining ring including these specially designed recesses or protrusions on the bottom surface can also function as an in situ conditioning ring.

Still referring to FIGS. 1A and 1B, the polish rate on the substrate 10 can also be improved by including mechanisms that guide slurry 213 through the retaining ring 110 to the outer edge of the substrate 10. For example, the retaining ring 110 can include a channel 210 that connects the outer surface 130 of the retaining ring to an inner surface 120. The channel 210 can be spaced apart from the polishing pad 32 so that the channel passes through the body of the retaining ring.

Figure 2:
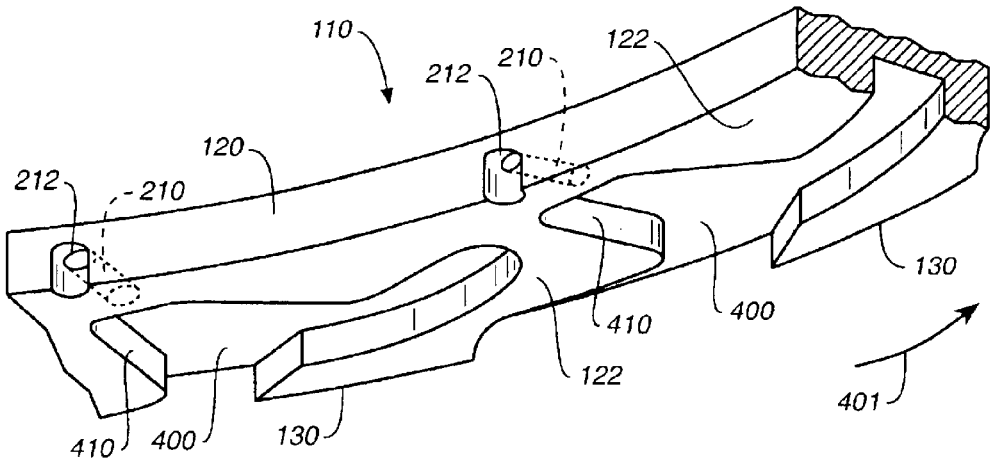
FIG. 2 is a perspective view of a section of another implementation of a retaining ring that includes a plurality of recesses on its bottom surface and a plurality of channels on its inner surface.

FIG. 2 shows a perspective view of a section of a retaining ring 110 that includes a plurality of recesses 400 on the bottom surface 122 of the retaining ring 110, a plurality of recesses 212 on the inner surface 120 of the retaining ring 110, and a plurality of channels 210 (illustrated in phantom) through the retaining ring 110 connecting the recesses on the bottom surface to the recesses on the inner surface. Each recess 400 includes an inner trailing surface 410 having a bottom edge that, as discussed in further detail below, will provide the stretching force. When the retaining ring 110 rotates relative to a polishing pad in a direction shown by arrow 401, the bottom edge of the inner trailing surface 410 generally contacts and moves against the polishing pad to exert a stretching force on the polishing pad. This stretching force pulls the polishing pad away from the substrate, potentially reducing distortion waves and possibly improving the uniformity of the polish rate on a substrate.

Figure 3A:
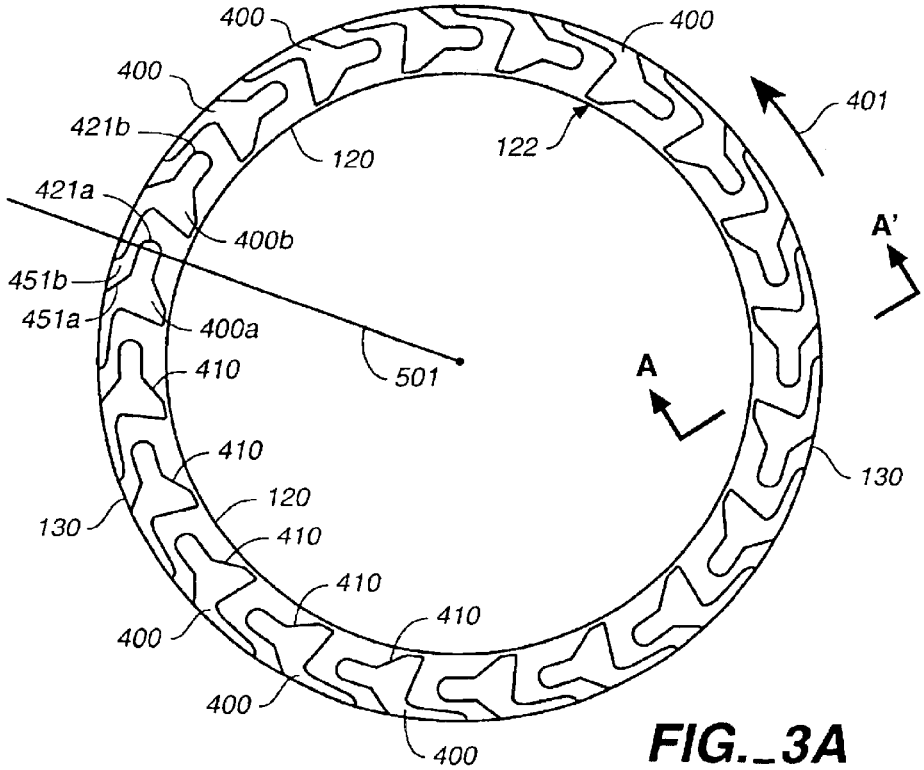
FIG. 3A is a planar view of the bottom surface of the retaining ring of FIG. 2.

FIG. 3A shows the bottom surface 122 of the retaining ring 110 in a planar view. The recesses 400 are positioned at equal angular intervals around the retaining ring 110. The recesses 400, which can be identical in shape or different in shape, can be arranged in a radially nesting pattern. For example, a feature 421*a* of a recess 400*a* can tangentially overlap with a feature 451*b* of a recess 400*b* such that a radius line 501 passes through both the feature 421*a* and the feature 451*b*. The recesses 400 can be shaped and positioned around the retaining ring 110 such that the total recessed area covered by the recesses 400 on the bottom surface 122 of the ring constitutes between 20% and 80% (e.g., 50%) of the original bottom surface area of the ring.

The bottom edge of the inner trailing surface 410 of the recess 400 contacts the polishing pad 32 and exerts the stretching force 201 (see FIGS. 1B and 3B) in a radial direction on the polishing pad 32.

FIG. 3B shows a cross-section of the retaining ring 110 in the A-A' plane. Slurry 213 trapped in the recess 400 can be directed through a channel 210 as slurry 215 to areas near the outer edge of the substrate 10. The channel 210 is placed in a plane Z-Z' that is parallel and at a distance from the bottom surface 122. As the retaining ring 110 wears during the useful life of the ring, the thickness of the retaining ring 110 gradually shrinks. However, this distance between the channel 210 and the bottom surface 122 can be selected to ensure that the channel 210 is not affected as the retaining ring 110 wears during the useful life of the retaining ring. In addition, the three dimensional shape of the recesses 400 can be designed, e.g., by making the walls of the recess substantially vertical, such that the retaining ring 110 can function with essentially unaffected performance even as the thickness of the ring shrinks.

FIG. 4 shows the retaining ring 110 in a planar view on the Z-Z' plane. As shown in the figure, each recess 400 is connected to the inner surface 120 of the retaining ring 110 through an associated channel 210.

Figure 5A:
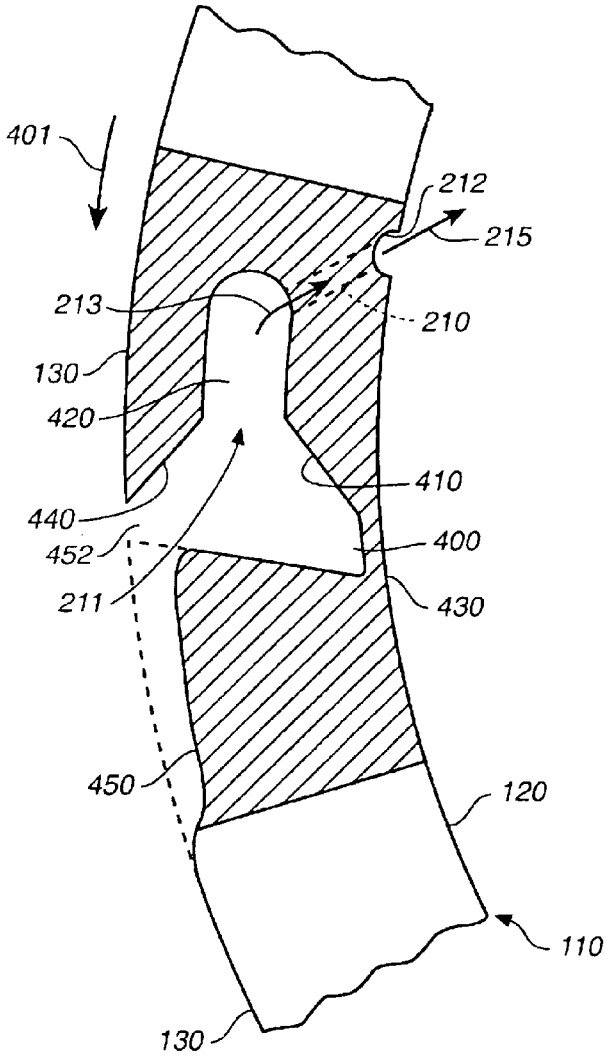
FIG. 5A is an expanded top planar view, partially cross-sectional, showing a recess on the retaining ring of FIG. 2.
Figure 5B:
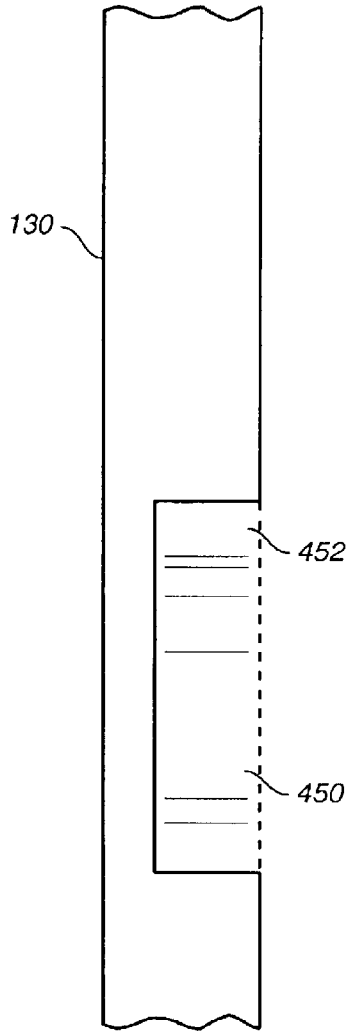
FIG. 5B is a side view showing the channel of the retaining ring of FIG. 5A.

FIGS. 5A and 5B show a single recess 400 in more detail. In FIG. 5A, a section of the retaining ring 110 indicated in shadowed area is cut out to show the features of the recess 400 (features of adjacent recesses are not shown in FIG. 5A for clarity). FIG. 5B shows the section of the retaining ring 110 in FIG. 5A in a side view. The recess 400 includes an inner trailing edge 410, a slurry capture area 420, and a closed inner wall 430. The recess 400 can also include an outer trailing edge 440 and a slurry feeding area 450. The recess 400 is also connected to the inner surface 120 of the retaining ring 110 through a channel 210.

The slurry feeding area 450 is a recess in the outer surface 130 designed to enhance the volume of slurry 211 that can be directed into the slurry capture area 420. Geometric variables of the retaining ring that can be used to optimize the performance of the slurry feeding area 450 includes the recessed length, height, recess depth (which can be continuous or non continuous), gap distance from the outer trailing edge 420, angle of inclination relative to the pad surface, surface roughness, and surface texturing. The trailing end of the slurry feeling area 450 opens to a passage 452 to the slurry capture area 420.

The area of the outer surface that is recessed to form the slurry feeding areas 450, combined with the area of outer surface that is cut away to form the openings 452, can constitute between 20% and 80% (e.g., 50%) of the total perimeter surface area of the outer surface 130 prior to machining. The geometry of the slurry feeding area 450, combined with the conditions of polishing process (e.g., head rotation speed, platen speed, and slurry flow rate), determines the volumetric-flow rate capability of the design.

Optionally, the retaining ring could be constructed without the slurry feeding area 450 (as shown in phantom), although in this case the passage 452 is still necessary to permit slurry flow into the recess 400.

When the retaining ring 110 rotates relative to a polishing pad in a direction shown by arrow 401, slurry (shown by arrow 211) near the outer surface 130 flows into the slurry feeding area, where it is directed through the passage 452 into the recess 400 and captured in the slurry capture area 420. The slurry (shown by arrows 213 and 215) is then directed into the channel 210 and delivered to areas near the inner surface 130 of the retaining ring 110. Without being limited to any particular theory, because slurry passes through the retaining ring via the channel 210, there is less contact between the slurry and the bottom surface 122 of the retaining ring 110. This can possibly reduce wear on both the retaining ring 110 and the polishing pad 32, and can reduce defects generated on the substrate during the polishing process.

In addition, because the slurry feeding area 450 and the slurry capture area 420 are designed to effectively direct and capture slurry introduced onto the polishing pad 32 into the retaining ring 110, both the total volume of the slurry required during the polishing process and unwanted loss of slurry off the polishing pad can be reduced. Consequently, the overall cost of polishing process can be reduced. Moreover, the overall cleanliness of the tool can be improved (by reducing the accumulation of dried slurry residue), thereby potentially reducing the likelihood of defects on the substrate.

As shown in FIG. 5A, a relief cut 212 can be made on the inner surface 120 of the retaining ring 110 to facilitate slurry (shown by arrow 215) flowing toward the bottom surface 122 of the retaining ring 110 and toward the surface of the substrate 10. The relief cut 212 can be radial chamfered to reduce the contact stress between the inner surface 120 and the edge of the substrate 10 during polishing.

The bottom edge of the inner trailing surface 410 is designed to exert a stretching force on the polishing pad underneath the bottom surface 122 of the retaining ring 110. The implementations and functions of the inner trailing surface 410 are explained in more detail with respect to FIGS. 6A–6C, 7A–7C, 8A–8D, 9A–9D, and 10. When the recess 400 includes an outer trailing edge 440, the retaining ring 110 can also function as an in situ conditioning ring. The implementations and functions of the outer trailing edge 440 are explained in more detail with respect to FIGS. 11A, 11B, 12, and 13.

Figure 6A:
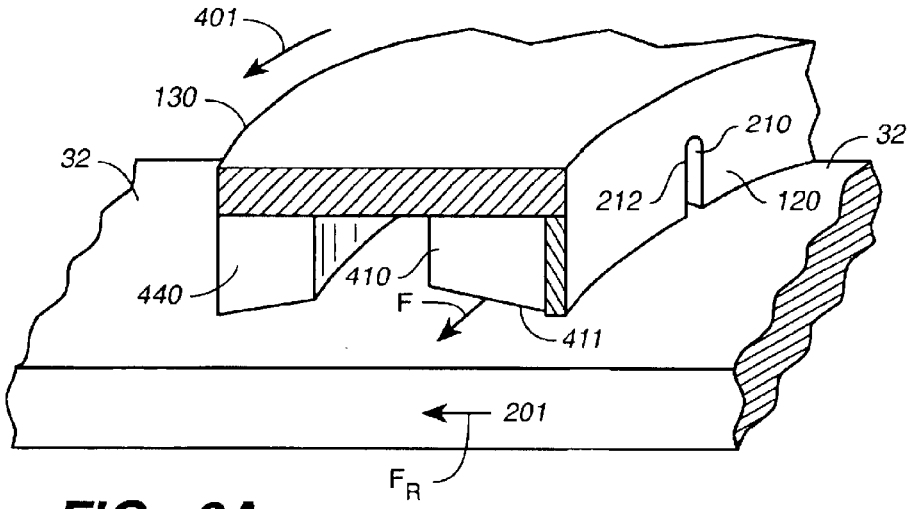
FIGS. 6A–6C illustrate an implementation of the inner trailing surface in the recess of FIG. 5A.
Figure 6B:
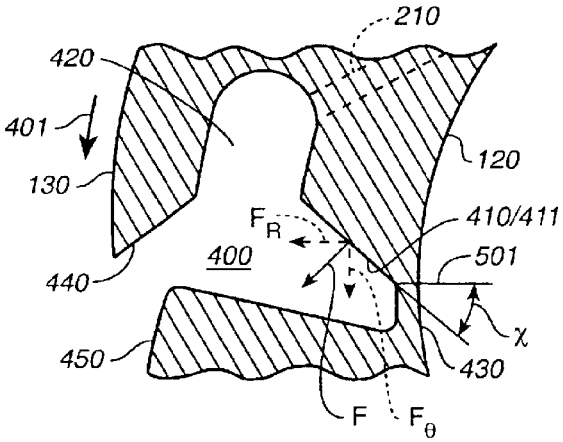
Figure 6C:
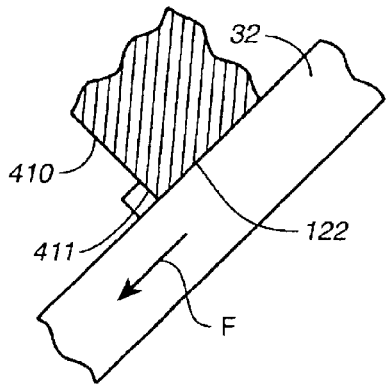

As shown in FIGS. 6A–6C, when the retaining ring 110 rotates relative to the polishing pad 32 in the direction shown by arrow 401, the bottom trailing edge 411 of the inner trailing surface 410 contacts the polishing pad 32 and moves against the polishing pad to exert a stretching force F in a direction normal to the trailing edge 411. The stretching force F is composed of a radial stretching force $F_R$=F sin $\chi$ and a tangential stretching force $F_\theta$=F cos $\chi$, where $\chi$ is a pad drive angle. As shown in 6B, the pad drive angle $\chi$ is an angle between the radius extending from the center of the retaining ring and the line of contact between the trailing edge 411 and the polishing pad 32. The radial stretching force $F_R$ is the stretching force 201 that is used for flattening the polishing pad 32 in the annular region 31.

Figure 7A:
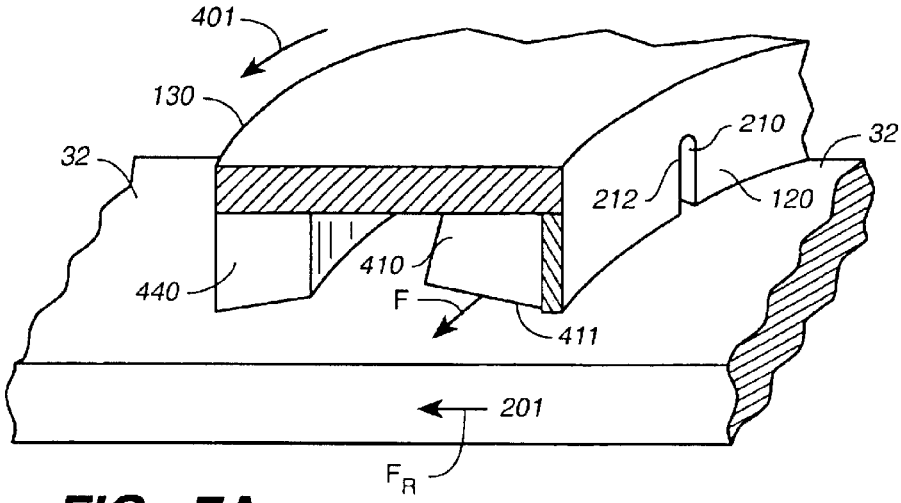
FIGS. 7A–7C illustrate another implementation of the inner trailing surface of the recess of FIG. 5A.
Figure 7B:
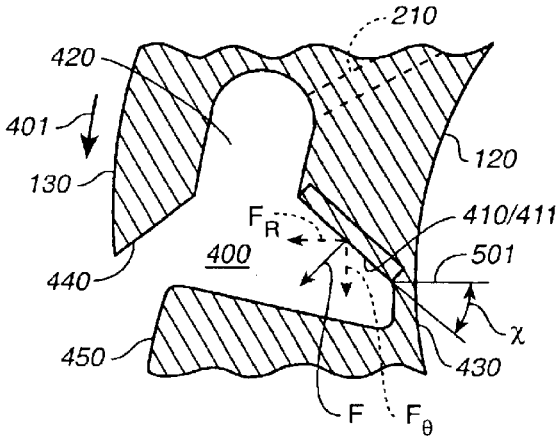
Figure 7C:
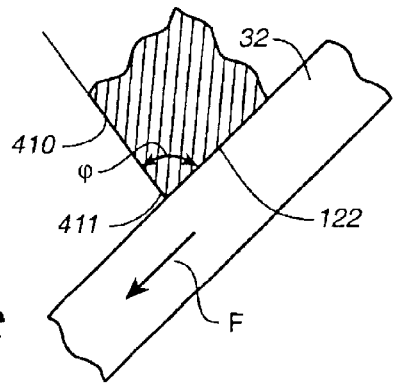

In one implementation, as shown in FIGS. 6A–6C, the inner trailing surface 410 is essentially perpendicular to the bottom surface 122 of the retaining ring 110. In another implementation, as shown in FIGS. 7A–7C, the inner trailing surface 410 inclines backward and forms an acute angle $\phi$ with respect to the bottom surface 122. As shown in FIG. 7C, when the inner trailing surface 410 inclines backward, the line of contact between the bottom trailing edge 411 and the polishing pad 32 is in front of the surface 410. Although not illustrated, the inner trailing surface 410 can also incline forward to form an obtuse angle ($\psi$ with respect to the bottom surface 122. When the inner trailing surface 410 inclines forward, the line of contact between the trailing edge 411 and the polishing pad 32 is behind the surface 410.

The inner trailing surface 410 of the recess 400 can be a flat plane, or it can be convex, concave, or some other shape.

Figure 8A:
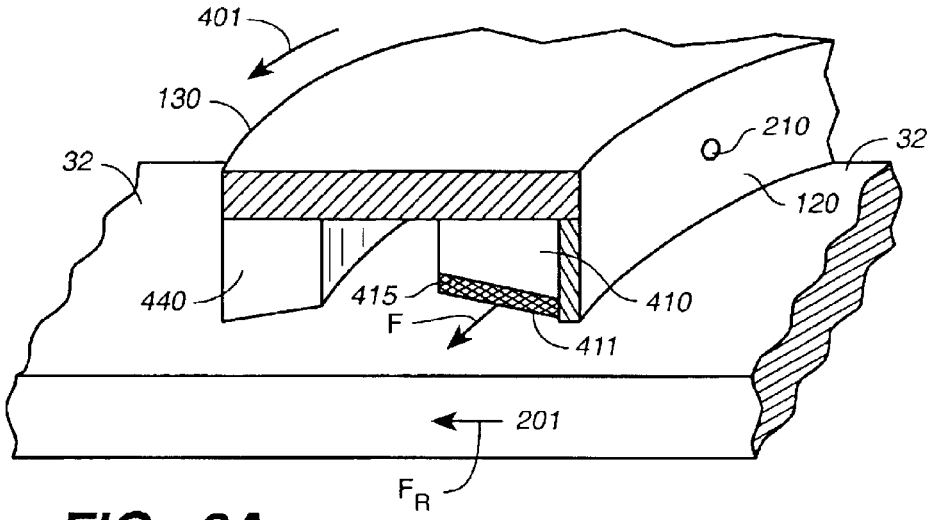
FIGS. 8A–8C illustrate a retaining ring having an insert tool fastened on the inner trailing surface of the recess.
Figure 8B:
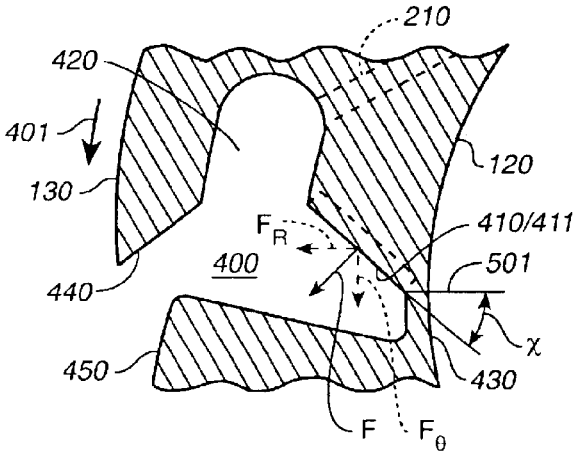
Figure 8C:
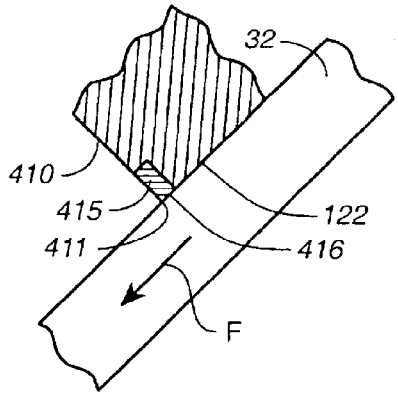

In yet another implementation, shown in FIGS. 8A–8C, a blade or insert tool 415 is secured to the retaining ring on the inner trailing surface 410 (the views are simplified for clarity and omits the mechanism to secure the insert tool to the retaining). The insert tool 415 can be made of a hard material, such as a carbide, e.g., silicon carbide, titanium carbide or tungsten carbide. The insert tool 415 has a contact surface 416 that contacts the polishing pad 32 to provide the trailing edge 411. The contact surface 416 can be in the same plane as the bottom surface 122, or it can also extend beyond the bottom surface 122. The distance that the contact surface 416 extends beyond the bottom surface 122 can be adjustable. In addition, the contact surface can be modified to adjust the friction coefficient between the contact surface 416 and the polishing pad 32. The contact surface 416 can include multiple contact regions or a single contact region.

FIGS. 9A–9E show various alternative implementations of the insert tool 415 (again, for simplicity, no specific mechanism to secure the insert tool to the retaining is shown).

Figure 9A:
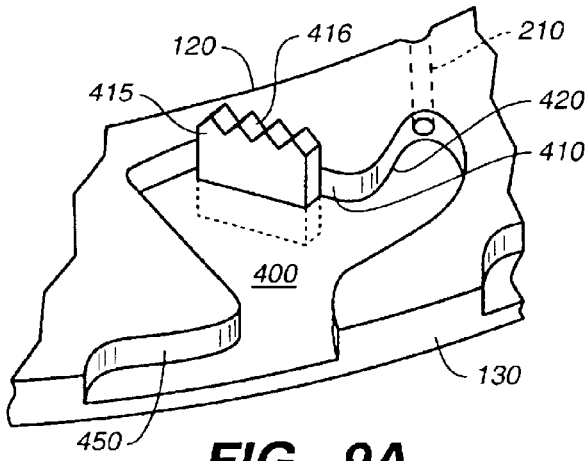
FIGS. 9A–9E illustrate other implementations of the insert tool.

FIG. 9A shows a perspective bottom view of an insert tool 415 fastened on the inner trailing surface 410 of the recess 400. As illustrated, this insert tool includes a serrated contact surface 416, so that the insert tool and the polishing pad will contact in the multiple regions. A portion of the insert tool (shown in phantom) may extend through an aperture in the upper surface of the recess 400.

Figure 9B:
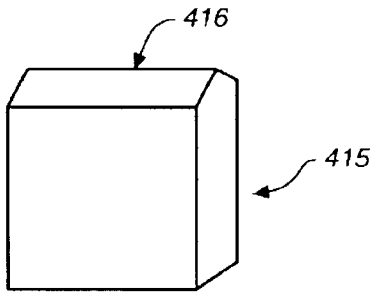

In FIG. 9B, the insert tool 415 has an end in the form of a scraper blade. The end of the scraper blade can be used to create an edge contact (a very thin contact area) between the contact surface 416 and the polishing pad.

Figure 9C:
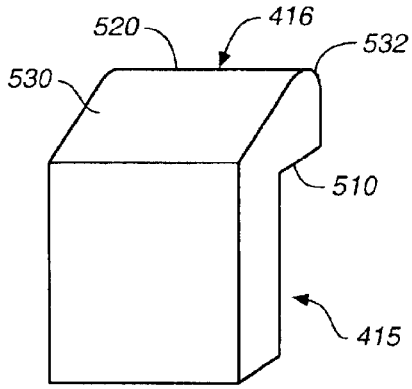
Figure 9D:
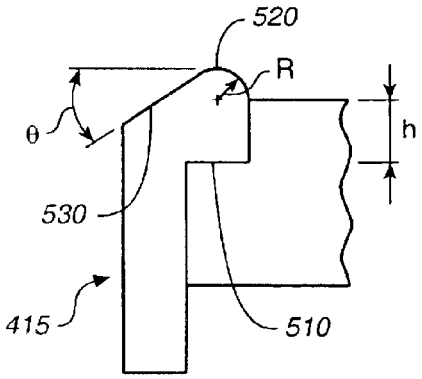

In FIGS. 9C and 9D, the insert tool 415 has a contact surface 416 in the form of a rounded peak 520 that at the end of a surface 530 that is tilted at an angle $\theta$ relative to the bottom surface 122 of the retaining ring. The combination of the rounded peak and a portion of the tilted surface 530 provides the contact area between the insert tool and the polishing pad. In particular, the rounded peak 520 can provide a contact strip (thicker than the edge contact that would be provided by the tool in FIG. 9B) between the insert tool and the polishing pad. The insert tool 415 also has a shoulder 510 for setting the height H of the contact area 416 with respect to the bottom surface 122.

Figure 9E:
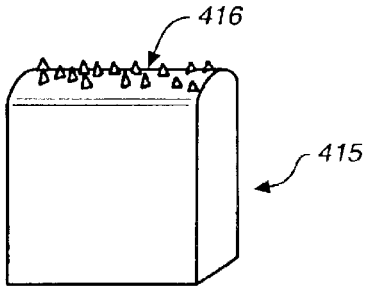

The contact edge or contact area of the blade or insert tool can be coated with or converted to a low-wear or high-abrasion material. In general, in implementations (such as FIGS. 9A and 9B) in which a sharp edge forms the effective conditioning element, the surface of the contact area 416 can be treated to provide a low wear characteristic. For example, a metal carbide contact area on the insert tool can be converted to a nanocrystalline diamond surface, as described in U.S. Patent Publication No. 2001/004780. Alternatively, in implementations (such as FIGS. 9C–9D) in which a rounded surface provides the contact area, the contact area can be coated with an abrasive material. For example, as shown in FIG. 9E, the rounded peak 520 of the contact surface 416 of an insert tool can be coated with 60 to 120 grit diamond using conventional nickel plating techniques.

Figure 10:
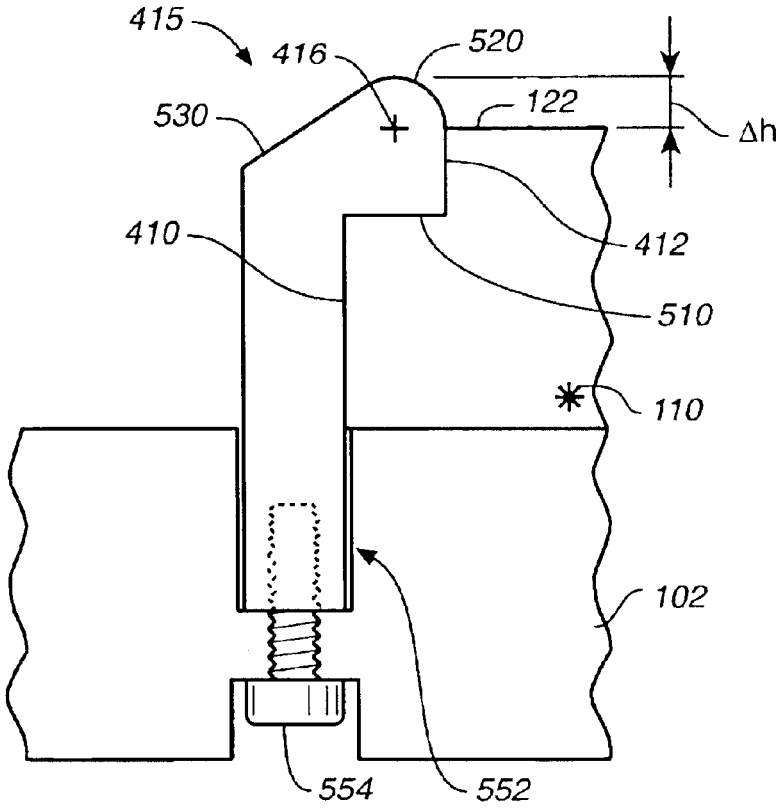
FIG. 10 illustrates a mechanism to fasten the insert tool at the inner trailing edge.

FIG. 10 shows the insert tool 415 of FIG. 9C fastened on the inner trailing surface 410. FIG. 10 also shows a segment of the retaining ring 110 and a segment of a metal base 102 of the carrier head 100. In the figure, the retaining ring 110 is adjacent to the metal base 102. The inner trailing edge 410 of the retaining ring 110 has a shoulder cut 412 for holding the shoulder 510 of the insert tool 415. The metal base 102 has a slot cut 552 that provides a precision slip fit for the tail end of the insert tool 415. By fixing the tail end of the insert tool 415 in the slot cut 552 using a screw 554, the insert tool 415 can be locked into position on the inner trailing edge 410 of the retaining ring 110.

Figure 11A:
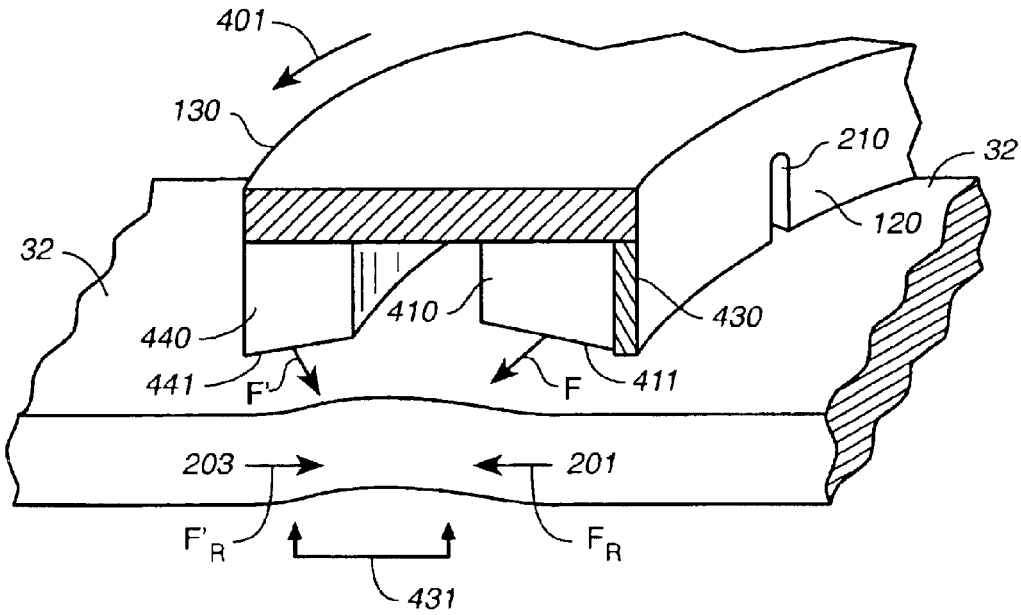
FIGS. 11A and 11B illustrate a recess on the retaining ring that includes an outer trailing edge.
Figure 11B:
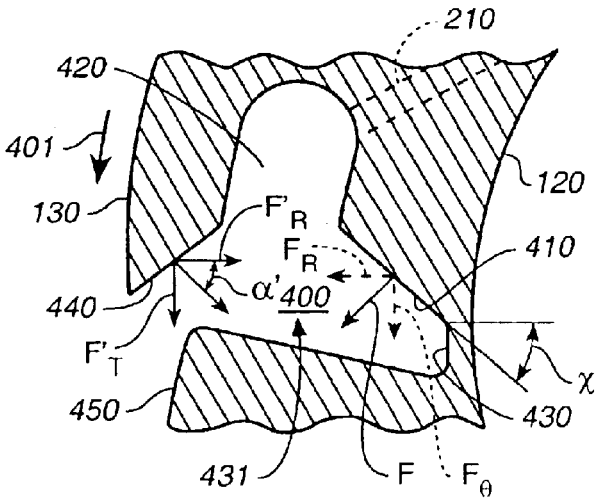

Referring to FIGS. 11A and 11B, the recess 400 can also include an outer trailing surface 440. When the retaining ring 110 rotates relative to the polishing pad 32 in the direction 401 during a CMP process, the outer trailing surface 440 contacts the polishing pad 32 along an outer edge 441 and exerts a stretching force F' to the polishing pad 32. The stretching force F' can be decomposed into a radius stretching force $F'_R$=F' sin $\alpha$, and a tangential stretching force $F'_T$=F' cos $\alpha$, where $\alpha$ is an angle between the radius extending from the center of the retaining ring and the line of contact between the outer edge 441 and the polishing pad. The radius stretching force $F'_R$ is in the opposite direction of the radius stretching force Fr. The opposing radius stretching forces $F_R$ and $F'_R$ act to deform and wrinkle the polishing pad 32 in an area 431 generally between the inner trailing surface 410 and the outer trailing surface 440. When an area of the polishing pad 32 is deformed and wrinkled the cell structures in the top surface of polishing pad material may be stretched and opened, and consequently that deformed area of the polishing pad 32 provides a means of enhancing slurry entrapment that is normally facilitated by pad conditioning means.

The outer trailing surface 440 can be perpendicular to the bottom surface 122 of the retaining ring 110. The outer trailing surface 440 can also have a backward inclination (forming an acute angle) or forward inclination (forming an obtuse angle) with respect to a reference plane perpendicular to the bottom surface 122. The outer trailing surface 440 can be planar, convex, concave, or have other shapes. The outer trailing surface 440 and the bottom surface 122 can also be coated with a hardening material, such as diamond or silicon carbide.

Figure 12:
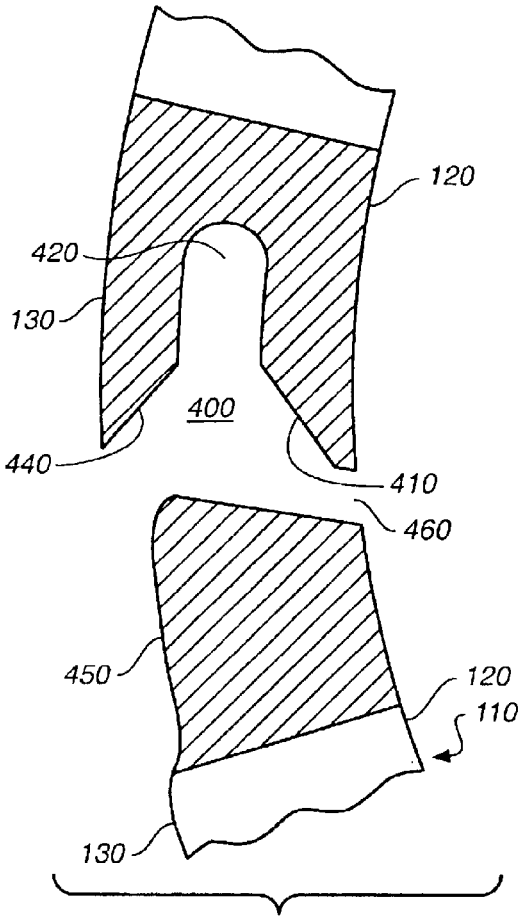
FIG. 12 is a planar view, partially cross-sectional, showing a retaining ring in which the recess includes an opening near the inner surface of a retaining ring.

In addition to the implementations shown previously, other implementations of the recess 400 are also possible. FIG. 12 shows an implementation of a recess 400 that includes an opening 460 near the inner surface 120 of the retaining ring 110. The opening 460 connects the recess 400 with the inner surface 120. When the recess 400 includes the opening 460, the channel 210 in FIG. 5A can be eliminated.

Figure 13:
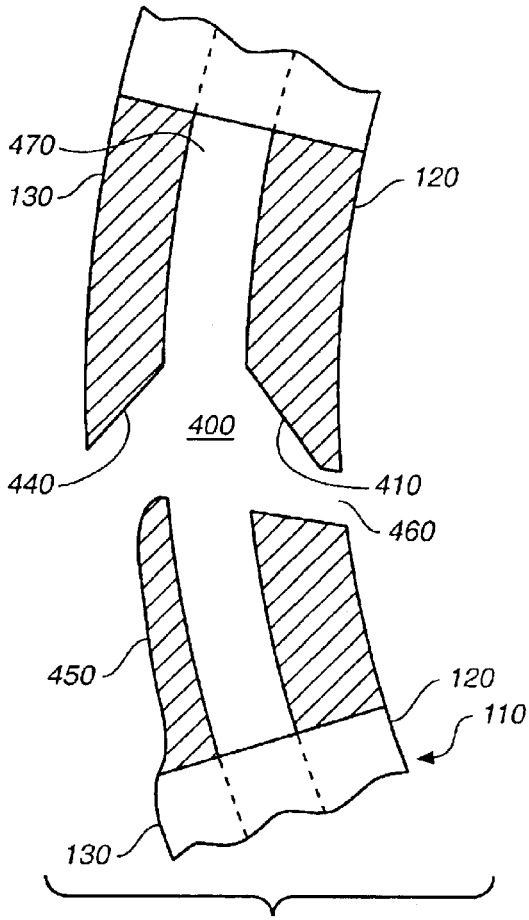
FIG. 13 is a planar view, partially cross-sectional, showing a retaining ring in which the recess includes an opening near to the inner circumferential surface and an annular channel connecting all the recesses.

FIG. 13 shows an implementation of a recess 400 that includes an opening 460 near the inner surface 120 of the retaining ring 110 and an annular channel 470 that connects all the recesses 400 on a retaining ring.

The retaining ring can be constructed from a polyphenyl sulfide (PPS), a polyimide, a polybenzimidazole (PBI) such as Celazole, a polytetrafluoroethylene (PTFE) such as Teflon or Avalon, a polyetheretherketone (PEEK) such as Arlon, a polycarbonate, an acetal such as Delrin, or an polyetherimide (PEI) such as Ultem. Polyimide can be obtained from Saint-Gobain Performance Plastics located at Garden Grove, Calif., under the trade name MELDIN™ 7001. In addition, the retaining ring can have an upper portion formed of a rigid material, e.g., a metal and a lower portion formed of a wearable material, e.g., a plastic such as one of the materials listed above, that is softer than the material of the upper portion. In this case, the recess can be formed solely in the lower portion.

A top surface of the retaining ring can include a plurality of holes, e.g., twelve holes spaced at equal intervals about the retaining ring, to receive screws, and screw inserts may be located in the holes. Moreover, a plurality of passages, e.g., four passages spaced at equal intervals about the retaining ring, can be formed horizontally or diagonally between the inner surface and outer surface of the retaining ring to provide pressure equalization, for injection of cleaning fluid, or expulsion of waste. The passages can be positioned vertically above the recesses so that they do not intersect the recesses. If the retaining ring includes a rigid upper portion and a softer lower portion, the passages can be formed through the rigid upper portion.

The present invention has been described in terms of a number of embodiments. The invention, however, is not limited to the embodiments depicted and described. Rather, the scope of the invention is defined by the appended claims.

What is claimed is:

1. A retaining ring for use on a carrier head in a chemical mechanical polishing apparatus, comprising:

an annular ring having a bottom surface, an inner surface and an outer surface; and a plurality of recesses on the bottom surface, each recess includes an inner trailing surface, a slurry capture area, and a channel connecting the slurry capture area to the inner surface.

2. The retaining ring of claim 1, wherein the inner trailing surface inclines backward and forms an acute angle with respect to the bottom surface.

3. The retaining ring of claim 1, wherein the inner trailing surface inclines forward and forms an obtuse angle with respect to the bottom surface.

4. The retaining ring of claim 1, wherein the inner trailing surface is configured for fastening thereon an insert tool having a contact edge for contacting abrasively a polishing pad on the chemical mechanical polishing apparatus.

5. The retaining ring of claim 1, wherein the annular ring is constructed from a material selected from a group consisting of polyphenyl sulfide (PPS), polyimide, polybenzimidazole (PBI), polytetrafluoroethylene (PTFE), polyetheretherketone (PEEK), polycarbonate, acetal, polyetherimide (PEI), or combinations thereof.

6. The retaining ring of claim 1, wherein at least one the recesses has a shape designed for nesting and is positioned on the bottom surface nested with at least another recess.

7. The retaining ring of claim 1, wherein the total recessed area covered by the plurality of recesses constitutes between 20% to 80% of the total projected surface area of the bottom surface.

8. The retaining ring of claim 1, wherein the channel is positioned in a plane that is essentially parallel and at a distance from the bottom surface.

9. The retaining ring of claim 1, wherein each recess has a three-dimensional shape designed to maintain the functional performance of the retaining ring as a thickness of the retaining ring shrinks.

10. The retaining ring of claim 1, wherein each recess includes a slurry feeding area.

11. The retaining ring of claim 1, wherein the slurry feeding area includes an opening on the outer surface of the annular ring and the total surface areas of all the openings on the outer surface constitute between 20% to 80% of the total projected surface areas of the outer surface.

12. The retaining ring of claim 1, wherein the inner surface includes a cut connecting to the channel.

13. The retaining ring of claim 1, wherein each recess includes an outer trailing surface.

14. The retaining ring of claim 1, wherein the outer trailing surface inclines backward and forms an acute angle with respect to the bottom surface.

15. The retaining ring of claim 1, wherein the outer trailing surface inclines forward and forms an obtuse angle with respect to the bottom surface.

16. The retaining ring of claim 1, further comprising an insert tool fastened on the inner trailing surface.

17. The retaining ring of claim 16, wherein the insert tool is made from a metal carbide.

18. The retaining ring of claim 17, wherein a surface of the insert tool is treated to enhance wear resistance.

19. The retaining ring of claim 16, wherein the insert tool has a contact edge including a single contact point.

20. The retaining ring of claim 16, wherein the insert tool has a contact edge including multiple contact points.

21. The retaining ring of claim 16, wherein the insert tool has an end in the form of a scraper blade.

22. The retaining ring of claim 16, wherein the insert tool has an end in the form of a rounded peak.

23. The retaining ring of claim 16, wherein the insert tool has a head that includes a rounded surface and a tilted surface.

24. The retaining ring of claim 16, wherein the insert tool has a shoulder for setting a height of a contact edge with respect to the bottom surface.

25. A retaining ring for use on a carrier head in a chemical mechanical polishing apparatus, comprising:

an annular ring having a bottom surface, an inner surface and an outer surface;

a plurality of recesses on the bottom surface, each recess includes an inner trailing surface, an outer trailing surface, and a slurry capture area between the inner trailing surface and the outer trailing surface; and a plurality of openings on the inner surface connecting with the slurry capture area.

26. The retaining ring of claim 25, wherein the inner trailing surface inclines backward and forms an acute angle with respect to the bottom surface.

27. The retaining ring of claim 25, wherein the inner trailing surface inclines forward and forms an obtuse angle with respect to the bottom surface.

28. The retaining ring of claim 25, wherein the outer trailing surface inclines backward and forms an acute angle with respect to the bottom surface.

29. The retaining ring of claim 25, wherein the outer trailing surface inclines forward and forms an obtuse angle with respect to the bottom surface.

* * * * *